US006991273B2

(12) United States Patent
Kim

(10) Patent No.: US 6,991,273 B2
(45) Date of Patent: Jan. 31, 2006

(54) TAILGATE HANDLE APPARATUS FOR VEHICLE

(75) Inventor: Yong-Soo Kim, Ulsan Metropolitan (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/749,205

(22) Filed: Dec. 30, 2003

(65) Prior Publication Data

US 2005/0082846 A1 Apr. 21, 2005

(30) Foreign Application Priority Data

Oct. 20, 2003 (KR) ..... 10-2003-0072845

(51) Int. Cl.
*E05B 3/00* (2006.01)

(52) U.S. Cl. ..... 292/336.3; 292/126; 292/DIG. 30; 292/DIG. 53; 292/DIG. 64; 296/146.8

(58) Field of Classification Search ..... 292/336.3, 292/26, 97, 126, DIG. 30, DIG. 43, DIG. 53, 292/DIG. 64; 296/146.8, 56, 106

See application file for complete search history.

(56) References Cited

U.S. PATENT DOCUMENTS

| | | | | |
|---|---|---|---|---|
| 3,848,909 | A * | 11/1974 | Foley | 292/216 |
| 4,157,844 | A * | 6/1979 | Sarosy et al. | 292/48 |
| 4,703,963 | A * | 11/1987 | Ball | 292/336.3 |
| 4,773,683 | A * | 9/1988 | Nakamura | 292/216 |
| 5,069,493 | A * | 12/1991 | Mochida et al. | 292/336.3 |
| 5,273,327 | A * | 12/1993 | Johnson et al. | 292/336.3 |
| 6,017,067 | A * | 1/2000 | Yoneyama et al. | 292/216 |
| 6,099,052 | A * | 8/2000 | Spitzley | 292/336.3 |
| 6,234,564 | B1 * | 5/2001 | Kim | 296/146.8 |
| 6,240,754 | B1 * | 6/2001 | Petersen | 70/417 |
| 6,523,869 | B1 * | 2/2003 | Jensen et al. | 292/336.3 |
| 6,758,513 | B2 * | 7/2004 | Choo | 296/146.8 |
| 2001/0042995 | A1 * | 11/2001 | Kim | 296/146.8 |

FOREIGN PATENT DOCUMENTS

JP 2000-118238 4/2000

* cited by examiner

*Primary Examiner*—Brian E. Glessner
*Assistant Examiner*—Carlos Lugo
(74) *Attorney, Agent, or Firm*—Morgan Lewis & Bockius LLP

(57) ABSTRACT

A tailgate handle apparatus is hidden in a tailgate having an upper panel and a lower panel both mounted in a vertical manner to give the tailgate a refined appearance. The tailgate handle apparatus is structured in a simple manner to give reliability in its operation and reduce the manufacturing cost of a vehicle.

5 Claims, 6 Drawing Sheets

TAILGATE HANDLE APPARATUS FOR VEHICLE

CROSS-REFERENCE TO RELATED APPLICATIONS

This application claims priority of Korean Patent Application No. 10-2003-0072845, filed on Oct. 20, 2003, which is incorporated fully herein by reference.

FIELD OF THE INVENTION

The present invention relates to a tailgate handle apparatus for a vehicle and, more particularly, to a tailgate handle apparatus for a vehicle which is mounted on tailgate panel composed of an upper panel and lower panel.

BACKGROUND OF THE INVENTION

Generally, a tailgate handle apparatus is preferably hidden in order not to influence the external appearance of a tailgate. Further, the tailgate handle apparatus should be simple in structure while being reliable in operation.

SUMMARY OF THE INVENTION

The present invention provides a simple and reliable tailgate handle apparatus adapted to enhance the external appearance of a tailgate by minimizing exposure of the tailgate handle apparatus at the exterior of the tailgate, comprised of an upper panel and lower panel, both disposed in a vertical manner.

In accordance with a preferred embodiment of the present invention, the handle apparatus for a tailgate having an upper panel and a lower panel for a vehicle, comprises a bracket mounting part mounted at an upper portion of the lower panel that forms a gap with the upper panel. A handle bracket is mounted at the bracket mounting part that bridges the gap. A lower end of the handle bracket is positioned above the lower end of the upper panel. A handle is rotatably hinged via a hinge connected to the handle bracket in which the bottom end of the handle is positioned above the lower end of the upper panel. A link mechanism is provided to transmit a rotating motion of the hinge to a tailgate latch.

BRIEF DESCRIPTION OF THE DRAWINGS

For a better understanding of the nature and objects of the present invention, reference should be made to the following detailed description with the accompanying drawings, in which.

DETAILED DESCRIPTION OF THE PREFERRED EMBODIMENT

The preferred embodiment of the present invention will now be described in detail with reference to the annexed drawings, where the present embodiment does not limit the scope of the present invention but is given only for illustrative purposes.

Figure 1:
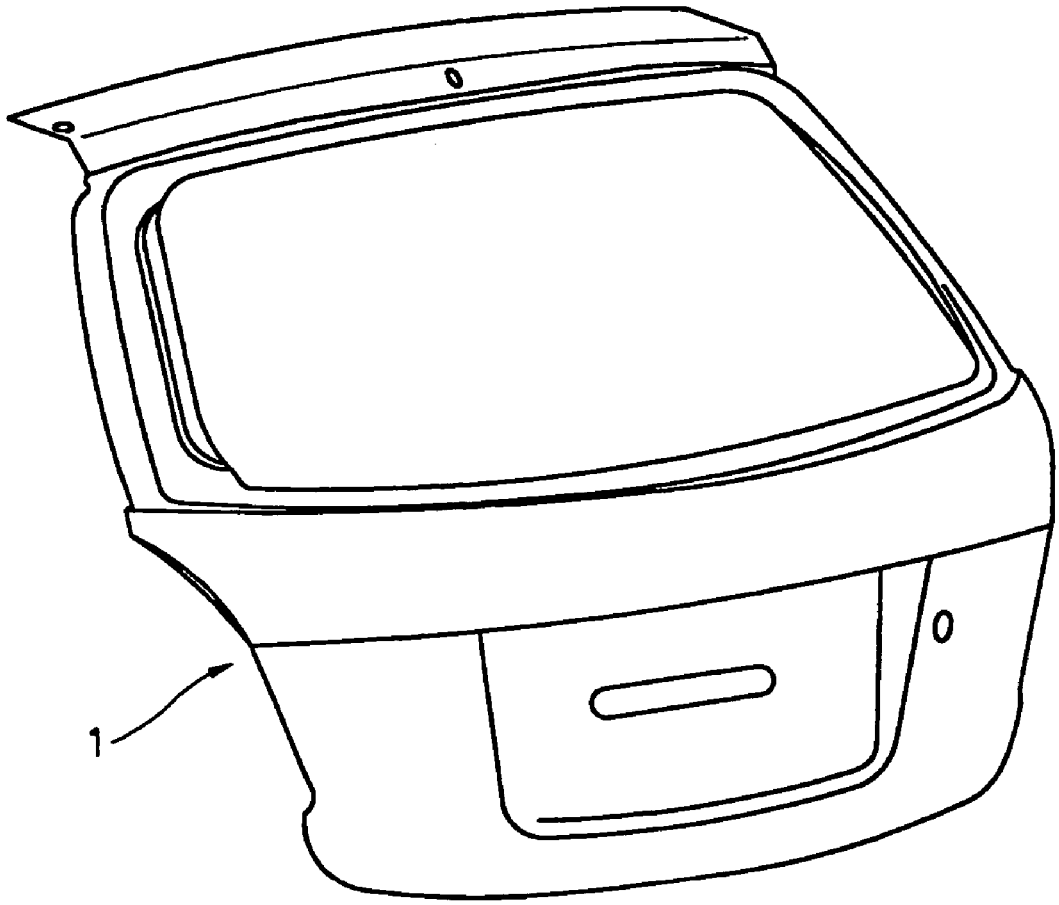
FIG. 1 is a perspective view of a tailgate according to an embodiment of the present invention.
Figure 2:
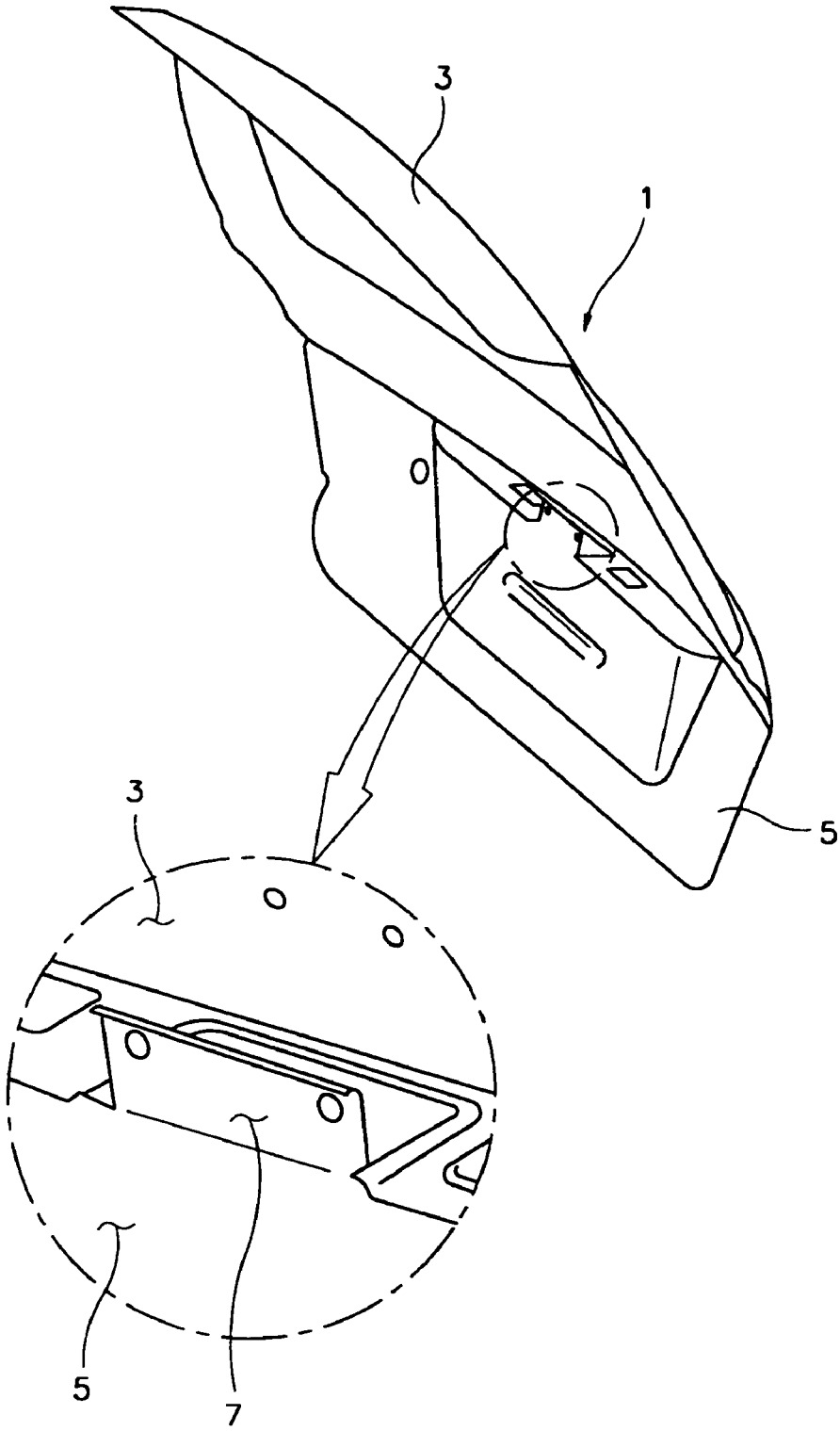
FIG. 2 is a perspective view of a tailgate observed from inside of a vehicle.
Figure 3:
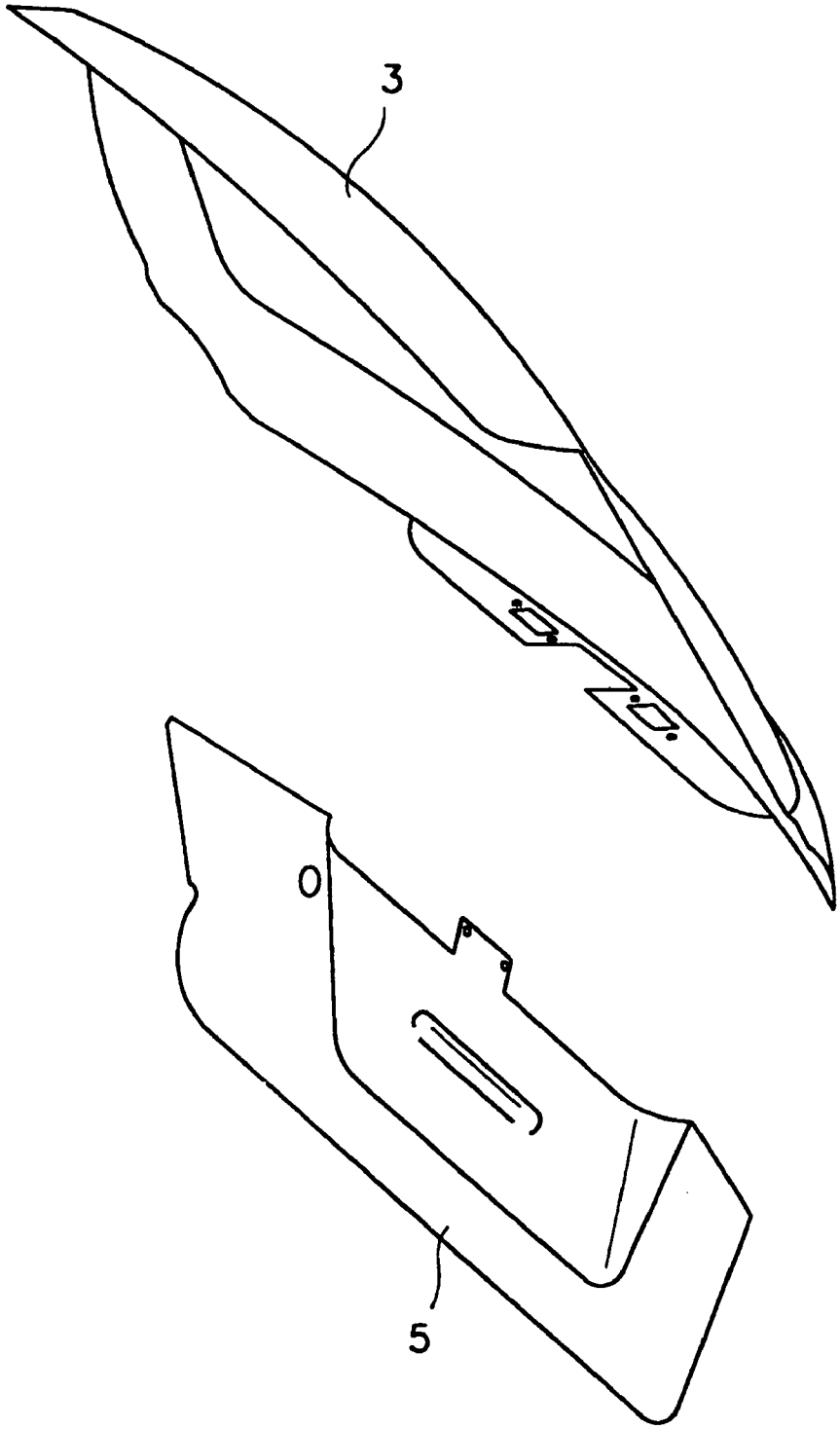
FIG. 3 is an exploded perspective view of a tailgate of FIG. 2.

FIGS. 1, 2 and 3 respectively illustrate a structure of an upper panel 3 and a lower panel 5 of a tailgate 1.

A bracket mounting part 7 forms a gap (G) above the lower panel 5 and inside the upper panel 3, and is protruded in an integral manner. The bracket mounting part 7 is mounted with a handle bracket 9. The handle bracket 9 fills the horizontal gap (G) with a lower end of the handle bracket 9 being positioned above the lower end of the upper panel 3. Details on the bracket mounting part 7 will be described later.

A handle 11 is rotatably hinged to the handle bracket via a hinge 13, with a lower end of the handle 11 being positioned above the lower end of the upper panel 3. As a result, the handle bracket 9 and the handle 11 are hidden by the upper panel 3. The handle 11 is connected to a link mechanism to transmit a rotating motion of the handle 11 to a tailgate latch 15. The link mechanism will be described further later.

Figure 4:
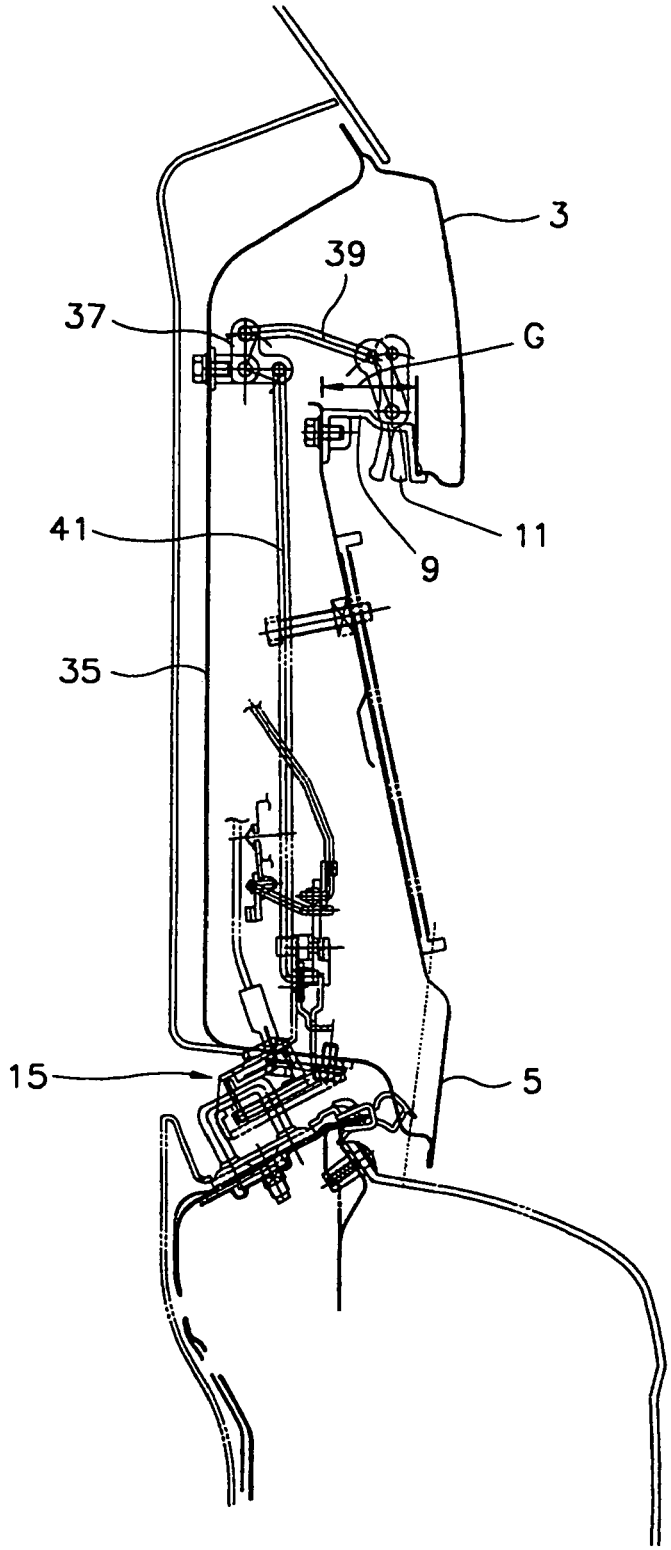
FIG. 4 is a cross-sectional view of a tailgate handle apparatus according to an embodiment of the present invention.
Figure 5:
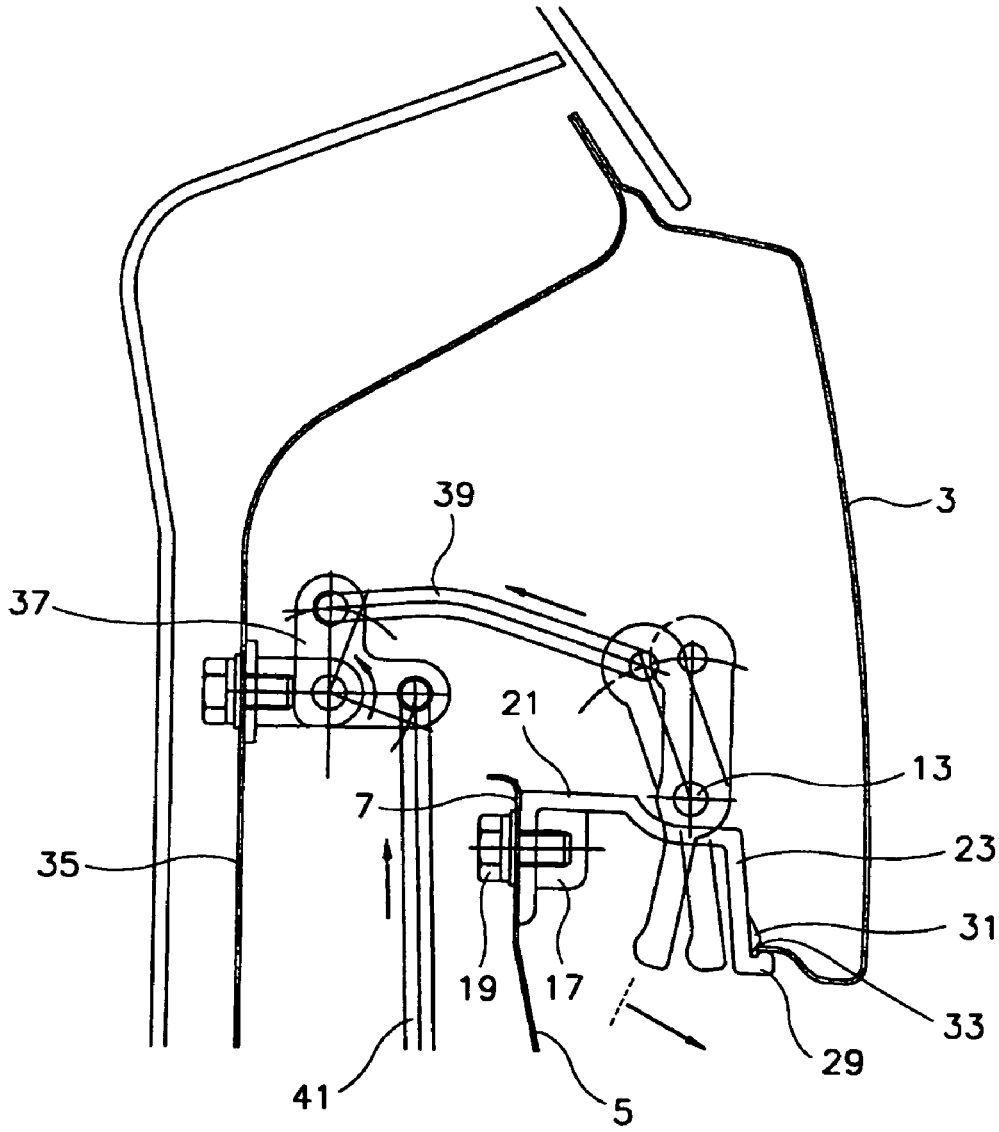
FIG. 5 is a detail view of essential parts of FIG. 4.

The bracket mounting part 7 protrudes vertically upwards from the upper side part of the lower panel 5, and the handle bracket 9 is fixedly abutted to the bracket mounting part 7 with a nut part 17, such that the handle bracket 9 is fixed to the bracket mounting part 7 via a bolt 19 as shown in FIGS. 4 and 5.

Figure 6:
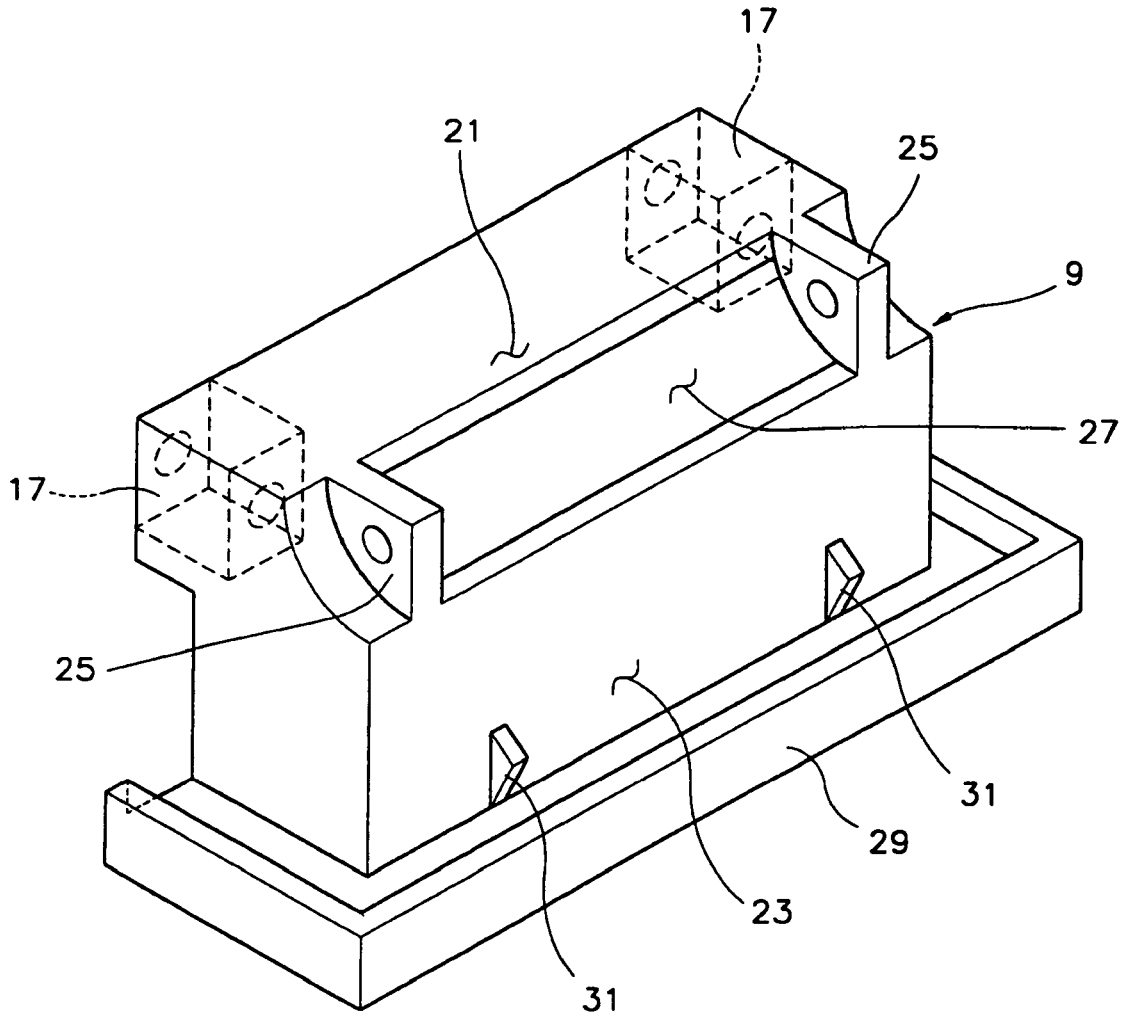
FIG. 6 is a perspective view of a handle bracket.

Referring to FIG. 6, the handle bracket 9 is box-shaped with a bottom that is open. The nut part 17 extends to a horizontal part 21 toward the upper panel 3, and the horizontal part 21 extends to a panel connector 23 to allow the lower end of the upper panel 3 to be connected.

A corner area between the horizontal part 21 and the panel connector 23 is disposed with a support part 25 for supporting the handle 11 via the hinge 13 and a through hole 27. The panel connector 23 is mounted with a lower side flange 29 and a hitching jaw 31, such that a distal end 33 formed by the lower side part of the upper panel 3 bent toward an inner side of the upper panel 3 and is fixedly inserted between the lower flange 29 and the hitching jaw 31.

The link mechanism includes a rotating plate 37 rotatably fixed to a tailgate inner panel 35, a handle side rod 39 connecting with the rotating plate 37 and the handle 11, and a latch side rod 41 connecting with the rotating plate 37 and a tailgate latch 15.

The rotating plate 37 is L-shaped and is centrally and rotatably coupled to a tailgate inner panel 35, and an upper branch of the rotating plate is rotatably coupled with the handle side rod 39 while a lower branch of the rotating plate is rotatably coupled to the latch side rod 41.

Next, the operation of the tailgate handle apparatus for a vehicle as constructed above will be described.

If the handle 11 is pulled toward the arrow direction as shown in FIG. 5, the handle side rod 39 moves toward the left in the drawing, and the direction of operating force is switched by the rotating plate 37 to allow the latch side rod 41 to be pulled upwards as shown in the drawing, thereby releasing the tailgate latch 15.

As a result, by simply inserting a hand from an external side of the upper panel 3 of the tailgate 1 to a lower side of the handle bracket 9, a person can easily pull the handle 11 to release the tailgate latch 15 that opens the tailgate 1.

As explained above, the present invention provides an embodiment for a transmitting structure to address the operating force from the handle 11 to the tailgate latch 15 that is very simple, such that reliability can be obtained in operating the handle apparatus of the tailgate.

Meanwhile, as described above, the tailgate handle apparatus for a vehicle is constructed so that the handle 11 and the handle bracket 8 are hidden in the inner side of the upper panel 3 to give the tailgate 1 a refined appearance.

As apparent from the foregoing, there is an advantage in the tailgate handle apparatus for a vehicle as described according to an embodiment of the present invention, in which the tailgate handle apparatus is hidden in the tailgate having an upper panel and a lower panel both mounted in a vertical manner, because it gives the tailgate a polished look.

There is another advantage in that the tailgate handle apparatus is embodied in a simple structure, while obtaining reliability in its operation and reducing the manufacturing cost of the vehicle.

The foregoing description of the preferred embodiment of the present invention has been presented for the purpose of illustration and description. It is not intended to be exhaustive or to limit the invention to the precise form disclosed, and modifications and variations are possible in light of the above teachings or may be acquired from practice of the invention. It is intended that the scope of the invention be defined by the claims appended hereto and their equivalents.

What is claimed is:

1. A handle apparatus of a tailgate having an upper panel and a lower panel for a vehicle, comprising:

a bracket mounting part mounted at an upper portion of said lower panel that forms a gap with upper panel, wherein said bracket mounting part protrudes vertically upwards from said upper portion of said lower panel;

a handle bracket mounted at said bracket mounting part that bridges said gap, with a lower end of said handle bracket being positioned above a lower end of said upper panel, wherein said handle bracket is fixedly abutted to said bracket mounting part with a nut part, wherein said nut part of said handle bracket extends into a horizontal part of said handle bracket towards said upper panel, and said horizontal part extends to a panel connector to allow the lower end of said upper panel to be connected;

a handle rotatably hinged via a hinge connected to said handle bracket with a bottom end of said handle being positioned above the lower end of said upper panel; and a link mechanism for transmitting a rotating motion of said hinge to a tailgate latch.

2. The apparatus as defined in claim 1, wherein said link mechanism comprises:

a rotating plate rotatably fixed to an inner tailgate panel;

a handle side rod connecting with said rotating plate and said handle; and a latch side rod connecting with said rotating plate and said tailgate latch.

3. The apparatus as defined in claim 2, wherein said rotating plate is L-shaped and is centrally and rotatably coupled to said inner tailgate panel, and an upper branch of said rotating plate is rotatably coupled with said handle side rod while a lower branch of said rotating plate is rotatably coupled to said latch side rod.

4. The apparatus as defined in claim 1, wherein a corner area between said horizontal part and said panel connector is provided with a support part for supporting said handle via said hinge and a through hole.

5. The apparatus as defined in claim 1, wherein said panel connector is mounted with a lower side flange and a hitching jaw, so that a distal end formed by a lower side part of said upper panel bent toward an inner side of said upper panel and is fixedly inserted between said lower side flange and said hitching jaw.

* * * * *